United States Patent [19]

Okamura et al.

[11] Patent Number: 4,897,344

[45] Date of Patent: Jan. 30, 1990

[54] METHOD OF HARDENING GELATIN

[75] Inventors: Hisashi Okamura; Hiroshi Kawamoto; Hiroshi Kawasaki, all of Kanagawa, Japan

[73] Assignee: Fuji Photo Film Co., Ltd., Kanagawa, Japan

[21] Appl. No.: 175,442

[22] Filed: Mar. 30, 1988

[30] Foreign Application Priority Data

Mar. 30, 1987 [JP] Japan ..... 62-76586

[51] Int. Cl.[4] ..... G03C 1/30

[52] U.S. Cl. ..... 430/622; 430/138; 430/621; 530/354

[58] Field of Search ..... 430/621, 622, 432, 138, 430/639, 640, 641, 642, 643; 427/161; 530/354

[56] References Cited

U.S. PATENT DOCUMENTS

| | | | |
|---|---|---|---|
| 3,689,274 | 9/1972 | Sobel et al. | 430/622 |
| 4,294,921 | 10/1981 | Yamaguchi et al. | 430/622 |
| 4,323,646 | 4/1982 | Bergthaller et al. | 430/622 |
| 4,349,624 | 9/1982 | Sobel et al. | 430/622 |
| 4,418,140 | 11/1983 | Mifune et al. | 430/351 |
| 4,476,218 | 10/1984 | Ogawa et al. | 430/539 |
| 4,543,324 | 9/1985 | Himmelmann | 430/622 |

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A method of hardening gelatin comprising adding to the gelatin to be hardened at least one compound represented by formula (I)

$$(CH_2{=}CH{-}SO_2)_2\underset{\underset{R}{|}}{C}{-}L{-}A{-}(SO_3^{\ominus}M^{\oplus})_n \qquad (I)$$

wherein L represents a divalent organic group, R represents a hydrogen atom or a univalent organic group, A represents a substituted or unsubstituted benzene ring which may be condensed with another ring, $M^{\oplus}$ represents a hydrogen ion, an alkali metal ion or an ammonium ion, and n has a value of 1 or 2 or 3. The method may be applied to various processes involving hardening of gelatin, such as processes for forming various photographic materials or microcapsules.

10 Claims, No Drawings

METHOD OF HARDENING GELATIN

FIELD OF THE INVENTION

This invention concerns a method of hardening gelatin with an improved hardening agent, and in particular it concerns a method of hardening the gelatin which can be applied to silver halide photographic materials.

BACKGROUND OF THE INVENTION

Gelatin in a layer-like form is employed as a binder in most photographic materials. Methods for hardening gelatin using a variety of compounds in order to increase the water resistance and mechanical strength of such gelatin layers were known in the past. It is important that the hardening reaction should be completed quickly when hardening the gelatin layers, and changes in the degree of hardness occur with the passage of time due to so-called after-hardening in cases where the hardening action on the gelatin is slow. It is well known that such after-hardening generates adverse effects (more precisely, increased fogging, a lowering of speed and a lowering of color density etc.) during the storage of photographic materials.

Moreover, the compounds which are used as hardening agents for gelatin must be highly soluble in water, and if their water solubility is low, then uneven hardening is liable to occur in the photographic emulsion layers, and special organic solvents must be used for the addition of the compounds to the photographic emulsion or photographic emulsion layers. Problems with uneven coating are liable to occur as a result of the presence of such solvents and care must also be taken to prevent explosions, etc.

Compounds for hardening gelatin in this way have been proposed for example in U.S. Pat. No. 3,642,486, Japanese Patent Publication No. 13563/74 and Japanese Patent Application (OPI) Nos. 73122/74 (corresponding to U.S. Pat. Nos. 3,841,872), 66960/78 (corresponding to U.S. Pat. Nos. 4,134,770) and 41221/78 (corresponding to U.S. Pat. No. 4,137,082) (the term (OPI) as used herein means a published unexamined Japanese patent application) where examples of the use of compounds which have a plurality of vinylsulfonyl groups within the same molecule as hardening agents for gelatin is disclosed.

However when these compounds are used as hardening agents for gelatin, there are problems with uneven hardening in the photographic emulsion layers since the compounds are all of low solubility in water, and the problem of uneven coating also arises because of the need to use organic solvents. Furthermore with some of these compounds the hardening reaction takes place slowly and the problem of "after-hardening" described earlier occurs.

An example of the use of compounds which have two vinylsulfonyl groups and sulfo groups in the same molecule as gelatin hardening agents is disclosed in Japanese Patent Application (OPI) No. 128240/86. These compounds have greatly improved water solubility, but the hardening reaction rate is inadequate in all cases, and so it is impossible to avoid the change in characteristics during storage of the photographic material which occur as a result of "after-hardening".

SUMMARY OF THE INVENTION

An aim of this invention is to provide a method of hardening gelatin with which the hardening effect occurs rapidly, and in which highly water soluble gelatin hardening agents are used.

As a result of thorough investigation, the inventors have discovered that the above mentioned aims can be realized by using compounds which can be represented by the general formula (I) indicated below as gelatin hardening agents. General Formula (I)

$$(CH_2{=}CH{-}SO_2)_2\underset{\underset{R}{|}}{C}{-}L{-}A{\leftarrow}SO_3^{\ominus}M^{\oplus})_n$$

In this formula L represents a divalent organic group and R represents a hydrogen atom or a univalent organic group. A represents a benzene ring which may be condensed with other rings. $M^{\oplus}$ represents a hydrogen ion, an alkali metal ion or an ammonium ion and n has a value of 1 or 2 or 3. Moreover the benzene ring A may be a substituted benzene ring.

DETAILED DESCRIPTION OF THE INVENTION

The present invention concerns a method by which hardening of gelatin can be caused to occur comprising adding to the gelatin to be hardened at least one highly water soluble compound represented by formula (I)

$$(CH_2{=}CH{-}SO_2)_2\underset{\underset{R}{|}}{C}{-}L{-}A{\leftarrow}SO_3^{\ominus}M^{\oplus})_n$$

wherein L represents a divalent organic group, R represents a hydrogen atom or a univalent organic group, A represents a substituted or unsubstituted benzene ring which may be condensed with another ring, $M^{\oplus}$ represents a hydrogen ion, an alkali metal ion or an ammonium ion, and n has a value of 1 or 2 or 3.

The compounds which are used in the invention are described in more detail below. Thus the divalent organic group represented by L in general formula (I) is preferably an alkylene group which has from 1 to 10 carbon atoms, an alkenylene group which has from 2 to 10 carbon atoms, an arylene group which has from 6 to 10 carbon atoms or a divalent group which can be represented by —O—, $$-\underset{\underset{R_1}{|}}{CON}-,$$

—COO—, —S—, —SO—, —$SO_2$— or $$\underset{\underset{R_1}{|}}{SO_2N}-,$$

or a divalent group in which a plurality of these divalent groups are combined. Here $R^1$ is a hydrogen atom, an alkyl group which has from 1 to 10 carbon atoms, an aryl group which has from 6 to 10 carbon atoms or an aralkyl group which has from 7 to 10 carbon atoms.

The benzene ring represented by A may be an unsubstituted or a substituted benzene ring and it may also be condensed with other rings. Examples of preferred substituent groups include halogen atoms, alkyl or alkoxy groups which have from 1 to 10 carbon atoms, aryl or aryloxy groups which have from 6 to 10 carbon atoms, aralkyl or aralkyloxy groups which have from 7 to 10 carbon atoms, acylamino groups which have from 1 to 10 carbon atoms and substituted or unsubstituted carbamoyl groups.

The univalent organic group represented by R is preferably a hydrogen atom, an alkyl group which has from 1 to 10 carbon atoms, an aryl group which has from 6 to 10 carbon atoms or an aralkyl group which has from 7 to 10 carbon atoms.

$M^{\oplus}$ is preferably $Na^{\oplus}$, $K^{\oplus}$ or $NH_4^{\oplus}$ and n is preferably 1 or 2.

Examples of compounds which can be used in the invention are indicated below but the invention is not limited to these compounds.

Compound 1

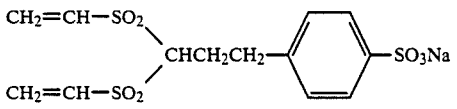

Compound 2

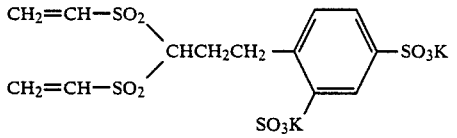

Compound 3

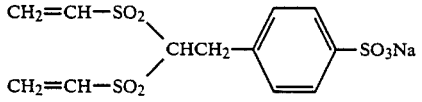

Compound 4

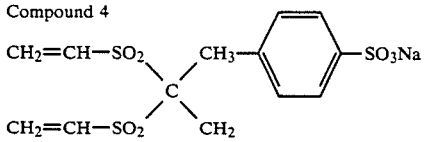

Compound 5

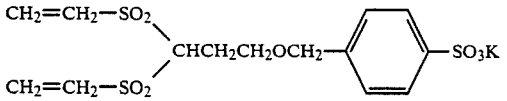

Compound 6

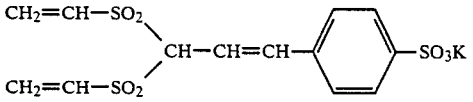

Compound 7

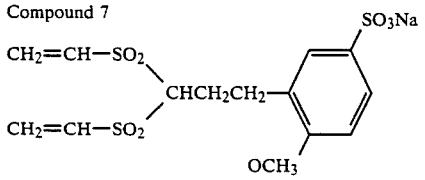

-continued

Compound 8

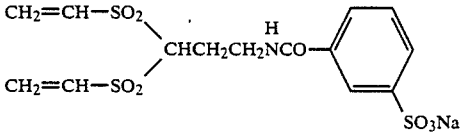

Compound 9

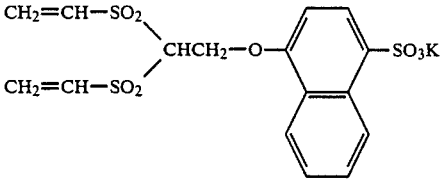

Compound 10

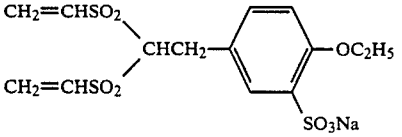

Examples of the synthesis of the compounds of the invention are described below. Unless otherwise indicated herein, all parts, percents, ratios and the like are by weight.

SYNTHESIS EXAMPLE 1 (SYNTHESIS OF COMPOUND 1)

(a) Synthesis of 1,1-bis-(2-hydroxyethylthio)-3-phenylpropane 3-Phenylpropanal (13.4 grams and 2-mercaptoethanol (15.6 grams) were dissolved in methanol (60 cc). Concentrated sulfuric acid (36N, 0.2 cc) was added and the mixture was heated under reflux for a period of 3 hours.

The methanol was then removed by distillation under reduced pressure and white crystals were obtained on adding n-hexane (50 cc) and ethyl acetate (10 cc) to the residual viscous liquid and stirring the mixture. The white crystals so obtained were recovered by reduced pressure filtration and dried to provide the target compound. (Yield 14 grams, m.p. 44°–46° C.)

The chemical structure was confirmed using various methods of spectroscopy and elemental analysis.

(b) Synthesis of 1,1-bis-(2-hydroxyethylsulfonyl)-3-phenylpropane 1,1-bis-(2-Hydroxyethylthio)-3-phenylpropane (9.5 grams) was dissolved in acetonitrile (50 cc). Sodium tungstate ($Na_2WO_4 \cdot 2H_2O$) (0.1 gram) was dissolved in water (5 cc) and added to the solution, and then 35% aqueous hydrogen peroxide (14.5 grams) was added slowly in a dropwise manner at a temperature of 70° C. or below.

On completion of the dropwise addition the mixture was heated with stirring for a period of 2 hours at a temperature of 70° to 73° C.

An aqueous sodium sulfite solution was added to degrade the excess hydrogen peroxide after the reaction had been completed. The acetonitrile was removed by distillation under reduced pressure and the residue was extracted with ethyl acetate (80 cc). The ethyl acetate layer was washed twice with water (80 cc) and then dried over anhydrous magnesium sulfate. The mixture was filtered after drying, the filtrate was concentrated under reduced pressure and the target compound in the form of a white powder was obtained by recrystallization from a mixed solvent consisting of methanol (15 cc) and water (20 cc). (Yield 9.5 grams, m.p. 86° C.).

The chemical structure was confirmed using various types of spectroscopy and elemental analysis. (c) Synthesis of 1,1-bis(vinylsulfonyl)-3-phenylpropane 1,1-bis-(2-Hydroxyethylsulfonyl)-3-phenylpropane (9.1 grams) was dissolved in ethyl acetate (60 cc) and cooled to below 0° C., and then methanesulfonyl chloride (4.2 cc) was added. Triethylamine (15.1 cc) was then added slowly in a dropwise manner at temperatures below 10° C. Once the addition had been completed, the mixture was stirred at room temperature for a period of 3 hours and then ethyl acetate and water were added and the mixture was allowed to separate. The ethyl acetate layer was washed with 1N hydrochloric acid and then with aqueous sodium bicarbonate and finally with water. The washed ethyl acetate layer was dried over anhydrous magnesium sulfate and filtered and the filtrate was concentrated under reduced pressure. The crystals obtained were recrystallized from methanol (75 cc) and water (15 cc) and the target compound was obtained in the form of a white powder. (Yield 6.5 grams, m.p. 71° C.)

The chemical structure was confirmed using various types of spectroscopy and elemental analysis.

(d) Synthesis of Compound 1

1,1-bis-(Vinylsulfonyl)-3-phenylpropane (1.5 grams) was dissolved in dichloromethane (90 cc) and cooled to below 0° C. A dichloromethane (15 cc) solution of anhydrous sulfuric acid (4.4 grams) was then added slowly in a dropwise manner at a temperature below 10° C. On completion of the addition, the mixture was stirred at room temperature for a period of 2 hours and then the dichloromethane was removed by distillation under reduced pressure. The viscous liquid so obtained was dissolved in methanol (80 cc), after which sodium acetate (4.1 grams) was added and the mixture was stirred at room temperature for a period of 1 hour. After reaction the insoluble material was removed by filtration, isopropyl alcohol (80 ml) was added to the filtrate and the mixture was stirred. The white crystals which precipitated out at this time were recovered by filtration and dried, whereupon Compound 1 was obtained. (Yield 12 grams, m.p. 132° C., with decomposition)

The chemical structure was confirmed using various types of spectroscopy and elemental analysis.

Compounds other than the example of which the synthesis has been described above can be prepared using these or similar procedures.

Virtually no undesirable phenomena such as deterioration of the photographic performance, i.e. fogging or desensitization etc., staining, or reaction with the couplers which are contained in color photographic material etc, have been observed to occur when these compounds are used as hardening agents in gelatin containing photographic layers. Furthermore, hardening proceeds very quickly, the final degree of hardness being reached within a few days after coating, and they have an advantage in that no subsequent hardening, which is to say so-called "after-hardening", is observed in practice.

The amount of hardening agent used in this invention can be selected arbitrarily in accordance with the intended purpose. Normally the hardening agents are used in a proportion within the range of from 0.01 to 20 wt % with respect to the dry gelatin. They are preferably used in a proportion of from 0.05 to 10 wt % with respect to the dry gelatin.

The hardening agents of this invention can also be used effectively as curing agents for the partial hardening in methods where long gelatin chains are grown by partial hardening as disclosed in Japanese Patent Application (OPI) No. 2324/81. They can also be used for hardening gelatins which have been extended into long chains of this type.

The hardening agents of this invention can be used in photographic materials in which gelatin is used. For example they can be used in color negative films, color reversal films, color positive films, color printing papers, color reversal printing papers or color photosensitive materials of the color diffusion transfer type or the silver dye-bleach type, and in black and white films, X-ray films, plate making films, black and white printing papers, aerial films, films for use in microscopy, films for facsimile purposes, films for photographic purposes or printing papers and other black and white photosensitive materials such as graphics films, etc.

No particular limitation is imposed upon the photographic layers in which the hardening agents of this invention are used and they can be used in gelatin-containing photographic layers such as non-photosensitive layers, for example, undercoating layers, backing layers, filter layers, intermediate layers, over-coating layers, etc., as well as in the silver halide emulsion layers.

The hardening agents of this invention may be used individually or in the form of mixtures of two or more types. Furthermore, they may also be used conjointly with other previously known hardening agents. Known hardening agents include, for example, aldehyde based compounds such as formaldehyde and glutaraldehyde, ketone compounds such as diacetyl and cyclopentanedione; compounds which have reactive halogen such as bis(2-chloroethylurea), 2-hydroxy-4,6-dichloro-1,3,5-triazine, and those disclosed in U.S. Pat. Nos. 3,288,775 and 2,732,303 and British Pat. Nos. 974,723 and 1,167,207; compounds which have a reactive olefinic group such as divinylsulfone, 5-acetyl-1,3-diacryloylhexahydro-1,3,3-triazine and also those disclosed U.S. Pat. Nos. 3,633,718 and 3,232,763 and British Pat. No. 994,869 etc.; N-methylol compounds such as N-hydroxymethylphthalimide and those disclosed in U.S. Pat. Nos. 2,732,316 and 2,586,168 etc.; the isocyanates as disclosed in U.S. Pat. No. 3,103,437; the aziridines disclosed in U.S. Pat. Nos. 3,017,280 and 2,983,611 etc.; the acid derivatives disclosed in U.S. Pat. Nos. 2,725,294 and 2,725,295 etc.; the carboxylimide based compounds as disclosed U.S. Pat. No. 3,100,704 etc.; the epoxy compounds disclosed in U.S. Pat. No. 3,091,537 etc., the iso-oxazole based compounds disclosed in U.S. Pat. Nos. 3,321,313 and 3,543,292 etc., the halogen carboxyaldehydes such as mucochloric acid, the dioxane derivatives such as dihydroxydioxane, dichlorodioxane, etc.; the dihydroquinoline based compounds; compounds which have a phosphorous-halogen bond; N-sulfonyloxyimido based compounds; N-acyloxyimino based compounds; the N-carbonyloxyimido based compounds disclosed in Japanese Patent Application (OPI) No. 43353/81 (corresponding to U.S. Pat. No. 4,427,768); 2-sulfonyloxypyridinium salts; N-carbamoylpyridinium salts; etc. Alternatively, chrome alum and zirconium sulfate, etc., can also be used as inorganic hardening agents. Furthermore, materials which take the form of precursors of these compounds, for example alkali metal bisulfite-aldehyde adducts, methylol derivatives of hydantoin, primary aliphatic nitroalcohols, methyloxyethylsulfonyl based compounds, chloroethylsulfonyl compounds, etc., can be used conjointly in place of the compounds indicated above. When a hardening agent of this invention is used conjointly with another hardening agent it can be used in any proportions according to the purpose and effect required, but the use of at least 50 mol % of the hardening agent of this invention is preferred.

Compounds which accelerate the hardening of gelatin can also be used conjointly with the hardening agents of this invention. For example the polymers containing sulfinic acid groups disclosed in Japanese Patent Application (OPI) No. 4141/81 (corresponding to U.S. Pat. No. 4,294,921) can be used conjointly as hardening accelerators in systems consisting of a hardening agent of this invention and a vinylsulfone based hardening agent.

The gelatins with which the hardening agents of this invention can be used may be so-called alkali treated (lime treated) gelatins which have been steeped in an alkali bath before gelatin extraction, acid treated gelatins which have been steeped in an acid bath and twice steeped gelatins which have been subjected to both treatments, or enzyme treated gelatins. Moreover the hardening agents can also be used in the partially hydrolyzed, low molecular weight gelatins obtained by subjecting these gelatins to heating in a water bath or to the action of protein degrading enzymes.

The gelatin in which the hardening agents of this invention are used may be replaced in part, as required, with up to 50% colloidal albumin, casein, a cellulose derivative such as carboxymethylcellulose or hydroxyethylcellulose, agar, sodium alginate, a sugar derivative such as starch derived dextran or a synthetic hydrophilic colloid, for example, poly(vinyl alcohol), poly(N-vinylpyrrolidone), poly(acrylic acid) copolymers, polyacrylamide or derivatives or partial hydrolyzates thereof, or it may be replaced by a so-called gelatin derivative.

When the hardening agents of this invention are used in photographic materials, they may be incorporated into the photographic emulsion layers or other layers individually or as mixtures with synthetic polymer compounds, for example latex-like water dispersible vinyl compound polymers, and especially with compounds for increasing the dimensional stability of the photographic material, or in combinations of these with hydrophilic water permeable colloids.

The gelatin hardening agents of this invention can be used along with matting agents in photographic materials. Matting agents consist of fine particles of water insoluble organic or inorganic compounds, preferably with an average grain size from 0.1μ to 10μ and most desirably with an average grain size of 0.3μ to 5μ.

The gelatin hardening agents of this invention can be used conjointly with a variety of color couplers.

Actual examples of the cyan, magenta and yellow couplers which can be used in the invention are disclosed in the patents cited in Research Disclosure (referred to below as RD) 18717 (November 1979) and in section VII-D of RD 17643 (December 1978).

The color couplers which are incorporated into photosensitive materials are preferably rendered fast to diffusion by means of ballast groups or by polymerization. Two-equivalent color couplers which are substituted with an eliminating group in the active coupling position require a lower coated silver weight and provide a higher speed than the four-equivalent couplers which have a hydrogen atom. Couplers of which the colored dyes have suitable diffusion properties, colorless couplers, DIR couplers which release development inhibitors along with the coupling reaction, and couplers which release development accelerators along with the coupling reaction can also be used.

The oil protected type acylacetamide based couples are typical of the yellow couplers which can be used together with the gelatin hardening agents of this invention.

The use of two-equivalent type yellow couplers is preferred in this invention, and the oxygen atom elimination type yellow couplers and the nitrogen atom elimination type yellow couplers are typical of such couplers. The α-benzoylacetanilide based couplers have excellent colored dye fastness, especially light fastness, while the α-benzoylacetanilide based couplers provide high color densities.

Oil protected type indazolone based couplers, cyanoacdetyl based couplers, and preferably 5-pyrazolone based couplers and pyrazoloazole based couplers such as the pyrazolotriazoles etc., can be used as the magenta couplers which can be used along with the gelatin hardening agents of this invention. The 5-pyrazolone based couplers substituted in the 3-position with an arylamino group or an acrylamino group are preferred from the points of view of the hue of the colored dyes and the color density. Aryl thio groups are especially desirable as the elimination group of the two-equivalent 5-pyrazolone based couplers. Furthermore the 5-pyrazolone based couplers which have ballast groups as disclosed in European Pat. No. 73,636 provide high color densities. Pyrazolobenzimidazoles, preferably pyrazolo[5,1-c][1,2,4]-triazoles, pyrazotetrazoles and pyrazolopyrazoles, can be used as pyrazoloazole based couplers. The use of the imidazo[1,2-b]pyrazoles is preferred in view of the low level of yellow absorption and the light fastness of the colored dye, and the use of pyrazole[1,5-b][1,2,4]triazole is especially desirable in this connection.

The oil protected type naphthol based and phenol based couplers can be used as cyan couplers along with the gelatin hardening agents of this invention and the naphthol based couplers disclosed in U.S. Pat. No. 2,474,293, and preferably the two equivalent naphthol based couplers of the oxygen atom elimination type, are typical of such couplers.

The use of cyan couplers which are fast to humidity and temperature is preferred in this invention, and typical examples of these couplers include the phenol based cyan couplers which have an alkyl group comprising at least an ethyl group substituted into the meta position of the phenol ring as disclosed in U.S. Pat. No. 3,772,002, the 2,5-diacylamino substituted phenol based couplers, the phenol based couplers which have a phenylureido group in the 2-position and an acylamino group substituted in the 5-position and the 2-naphthoic acid amide based couplers which have a hydroxyl group substituted in the 1-position and an acylamino group or an alkoxycarbonylamino group substituted in the 5-position.

The conjoint use of colored couplers is preferred in color sensitive materials for picture taking purposes in order to compensate for the unwanted absorptions in the short wavelength region of the dyes which are formed from the magenta and cyan couplers.

Couplers of which the colored dyes have suitable diffusion properties may be used conjointly for improving graininess.

The gelatin hardening agents of this invention may be used conjointly with couplers (so-called DIR couplers) which release development inhibitors during the course of development.

The DIR couplers which can be used include those which release a heterocyclic mercapto based development inhibitor; those which release a benzotriazole derivative as a development inhibitor; colorless DIR couplers; those which release a nitrogen-containing heterocyclic development inhibitor along with the dissociation of a methylol group after elimination; those which release a development inhibitor along with an intramolecular nucleophilic reaction after elimination; those which release a development inhibitor by means of an electron transfer via a conjugated system after elimination; those which release diffusible development inhibitors of which the development inhibiting capacity is deactivated in the development bath; and those which may form a development inhibitor, or deactivate a development inhibitor, by means of a reaction within the film during development, etc.

Compounds which release electron donating compounds or precursors thereof by means of a coupling reaction or a redox reaction with the oxidized form of the developing agent can be used conjointly when the invention is applied to photosensitive materials.

When various types of coupler are used conjointly in this invention, then two or more types can be used in the same photosensitive layer and the same compounds can be introduced into two or more layers in order to satisfy the properties required of the photosensitive material.

When the invention is applied to silver halide photosensitive materials, the silver halide emulsion typically contains silver chloride or silver bromide or a mixed silver halide, for example silver chlorobromide, silver chloroiodobromide, silver iodobromide, etc. The average grain size of the silver halide grains is preferably not greater than 2μ and no less than 0.1μ. The grain size distribution may be narrow or wide. So called monodisperse silver halide emulsions in which the grain size distribution is narrow with at least 90%, and preferably 95%, of all the grains either in terms of weight or numbers of grains being within ±40% of the average grain size are preferably used in the invention.

The silver halide grains used in the invention may have a regular crystalline form such as a cubic, octahedral, dodecahedral or tetradecahedral form, or they may have an irregular form such as a spherical form, or alternatively they may have a complex form including these crystal forms. Furthermore, the silver halide may take the form of plate-like grains, and emulsions in which plate-like grains of which the value of the length/thickness ratio is at least 5, and more especially 8 or above, account for at least 50% of the total projected grain area are particularly useful.

The silver halide emulsions to which the invention can be applied can be chemically sensitized by means of sulfur or selenium sensitization, reduction sensitization, precious metal sensitization, etc., and these methods of sensitization may be used individually or conjointly.

The photographic emulsions to which the invention can be applied can be spectrally sensitized by means of photographic sensitizing dyes. Cyanine dyes, merocyanine dyes, complex cyanine dyes, complex merocyanine dyes, holopolar cyanine dyes, hemi-cyanine dyes, styril dyes and hemi-oxonol dyes are included among the dyes which can be used for this purpose. Dyes belonging to the cyanine dyes, merocyanine dyes and the complex merocyanine dyes are especially useful. All of the nuclei which are normally used in the cyanine dyes can be used for the basic heterocyclic nucleus in these dyes.

These sensitizing dyes can be used individually or combinations of dyes may be used, and combinations of dyes are often used especially with a view to providing strong color sensitization.

Various compounds can be included in the photographic emulsions to which the invention can be applied with a view to preventing the occurrence of fogging during the manufacture, storage or photographic processing of the photosensitive material or with a view to stabilizing photographic performance. That is to say many compounds which are known to function as antifoggants and stabilizing agents, such as the azoles, for example benzothiazolium salts, benzimidazolium salts, imidazoles, benzimidazoles (preferably 5-nitrobenzimidazoles), nitroimidazoles, benzotriazoles (preferably 5-methylbenzotriazoles), triazoles etc.; mercapto compounds, for example mercaptothiazoles, mercaptobenzothiazoles, mercaptobenzimidazoles, mercaptobenzoxazoles, mercaptooxadiazoles, mercaptothiadiazoles, mercaptotriazoles, mercaptotetrazoles (especially 1-phenyl-5-mercaptotetrazoles etc.), mercaptopyrimidines, mercaptotriazines etc.; the thiocarbonyl compounds such as oxazolinethione; the azaindenes, for example triazaindenes, tetraazaindenes (especially 4-hydroxy-6-methy(1,3,3a,7)tetrazaindene), pentaazaindenes etc.; benzene thiosulfonic acids; benzene sulfinic acids; benzene sulfonamides; and purines such as adenine, etc. can be added for this purpose.

Photosensitive materials made using this invention may contain one or more type of surfactant as a coating promoter or with a view to preventing the build up of static charges, improving slip properties, emulsification and dispersion, the prevention of sticking or improving the photographic characteristics (for example accelerating development, enhancing contrast, sensitization etc.).

Thus non-ionic surfactants such as saponin (steroid based) alkyleneoxide derivatives (for example poly(ethylene glycol), poly(ethyleneglycol)/poly(polypropyleneglycol) condensates, poly(ethylene glycol) alkyl ethers or poly(ethylene glycol) alkyl aryl ethers, poly(ethylene glycol) esters, poly(ethylene glycol) sorbitane esters, poly(alkylene glycol) alkyl amines or amides, polyethyleneoxide adducts of silicones, etc.) fatty acid esters of polyhydric alcohols, alkyl esters of sugars etc.; and anionic surfactants which contain acidic groups such as carboxyl groups, sulfo groups, phospho groups, sulfate ester groups, phosphate ester groups etc, such as alkylcarboxylates, alkylsufonates, alkylbenzenesulfonates, alkylnaphthalenesulfonates, alkyl sulfate esters, alkyl phosphate esters, N-aceyl-N-alkyltaurines, sulfosuccinate esters, sulfoalkylpolyoxyethylenealkylphenylethers, polyoxyethylene alkylphosphate esters etc. can be used as surfactants.

Moreover the use of fluorine containing surfactants is preferred. The compounds disclosed in Japanese Patent Publication Nos. 43130/73, 44411/81 and 9303/73 are preferably used as the fluorine containing surfactants.

Various stabilizers, anti-staining agents, developing agents or precursors thereof, development accelerators or precursors thereof, lubricants, mordants, matting agents, anti-static agents, plasticizers or various additives which are useful photographically may be added to the photosensitive materials made using this invention as well as the additives described above. Typical examples of these additives have been disclosed in RD 17643 (December 1978) and RD 18716 (November 1979).

No particular limitation is imposed on the development process used for the development of photosensitive materials made using this invention, and the known color development and black and white development processes may be used. Reference can be made to the disclosures in the aforementioned RD 17643 (December 1978) in connection with development processes.

The hardening agents of this invention can be used to harden gelatin other than photographic materials where use is made of their rapid effect.

For example, methods exist for the microencapsulation of hydrophobic oily liquids using the complex coacervation of gelatin, and the hardening agents of this invention can also be used to harden the gelatin which forms the walls of such microcapsules.

An example of a known method for the production of microcapsule is indicated below. This consists of four processes, namely:

(1) An emulsification process in which an oil which is immiscible with water is emulsified in an aqueous solution (the first sol) of at least one type of hydrophilic colloid which is ionized in water and an aqueous solution (the second sol) of a hydrophilic colloid which is ionized in water and which has a charge opposite to that of the colloid in the first sol is mixed with the previously emulsified liquid, or in which an oil which is immiscible with water is emulsified in an aqueous solution of at least two types of hydrophilic colloid (of which at least one has an opposed charge) which can ionize in water;

(2) A coacervation process in which coacervation is carried out by the addition of water or pH adjustment, and a complex colloid is attached to the outside of individual oil droplets;

(3) A gelling process in which the coacervate is cooled and gelled; and (4) A process in which the pH is adjusted to the alkaline side in the presence of a hardening agent represented by the above formula (I), in which a hardening agent is added after adjusting the pH to the alkaline side or in which a hardening agent and an alkali are added simultaneously.

The microcapsules obtained using the method outlined above are very unstable and so problems such as coagulum formation arise during the manufacturing process where the material is left to stand for a long period of time under buffered conditions below normal temperature and hardening proceeds gradually. Hence the quick acting hardening agents of this invention are ideal for use in this application.

The microcapsules obtained can be used in pressure sensitive papers, heat sensitive papers, encapsulated toners for use in electronic photocopying etc.

The compounds represented by the aforementioned general formula (I) which are used in the invention are useful for hardening gelatin. More precisely, the compounds of this invention have a rapid hardening effect when used for hardening the gelatin used in silver halide photographic materials and so there is little "after-hardening" effect. Furthermore, the compounds are highly soluble in water and so there is no need to use a special organic solvent and uneven hardening does not occur.

The compounds this invention are quick-acting and so they can also be used in areas where gelatin capsules are used such as pressure sensitive papers, heat sensitive papers and toners for electronic photocopiers etc.

The invention is described below by means of examples but the invention is not limited to these examples. In these examples, the term "corresponding sphere diameter" used for silver halide grains means that the diameter of irregular grains is determined as a diameter of true sphere grains having the same volume as that of the irregular grains.

REFERENCE EXAMPLE

Ten grams of Compound 1 of this invention and 10 grams of Comparative Compound (I) disclosed (as illustrative compound 3) in Japanese Patent Application No. 41221/78 for comparative purposes were each separately dissolved in 100 ml of water and stirred for 5 hours while maintaining a temperature of 25° C. The undissolved portion was recovered by filtration and the weight of the recovered material was determined after drying. Comparative Compound (I)

$$CH_2{=}CHSO_2CH_2CONHCH_2CH_2NHCOCH_2SO_2CH{=}CH_2$$

The weights of the compounds recovered and the amounts dissolved in 100 ml of water at 25° C. calculated on the basis of the weights recovered are shown in Table 1. It is clear from these results that Compound 1 of this invention has much better solubility in water than the known Comparative Compound (I).

TABLE 1

| Compound | Weight Recovered | Weight Dissolved in 10 ml of Water at 25° C. |
|---|---|---|
| Compound 1 (This Invention) | 0 gram (No insoluble fraction) | More than 10 grams |
| Comparative Compound (I) | 8.0 grams | 2.0 grams |

EXAMPLE 1

A photosensitive emulsion layer which contained silver halide grains prepared using the method described below and a non-photosensitive hydrophilic colloid layer were extruded at the same time in this order onto a polyethyleneterephthalate film support which had been undercoated to a thickness of 180 μm and coated and dried. The two aforementioned layers were also coated in the same way onto the other side of the support to form an X-ray film for direct photography.

(i) Preparation of the Silver Halide Emulsion

Gelatin (30 grams) and 6 grams of potassium bromide were added to 1 liter of water and stirred in a container which was maintained at a temperature of 60° C. An aqueous solution of silver nitrate (5 grams as silver nitrate) and an aqueous potassium bromide solution which contained 0.15 grams of potassium iodide were then added over a period of 1 minute using the double jet method. Moreover, an aqueous solution of silver nitrate (145 grams as silver nitrate) and an aqueous potassium bromide solution containing 4.2 grams of potassium iodide were added using the double jet method. The rates of addition at this time were adjusted in such a way that the rate of addition at the end of the addition was five times the initial rate of addition. Once the addition had been completed, the water soluble salts were removed at 35° C. using the sedimentation method, after which the temperature was raised to 40° C., 75 grams of gelatin was added and the pH was adjusted to 6.7.

The finished emulsion contained plate-like grains of projected area diameter 0.98 μm and average thickness 0.138 μm and the silver iodide content was 3 mol %. This emulsion was chemically sensitized using gold and sulfur sensitizers conjointly. Compound 1 of this invention, Comparative Compound (I) of the reference example and Comparative Compound (II) disclosed (as illustrative Compound 6) in Japanese Patent Application (OPI) No. 128240/86 were each added in the proportions shown in Table 2 to this emulsion liquid as hardening agents. The specific gravity of the emulsion liquid was 1.140, and the amount of silver and gelatin together coated on one side was 2.5 grams per square meter.

(ii) Preparation of the Coating liquid for the Non-Photosensitive Hydrophilic Colloid layer Poly(methyl methacrylate) grains (average grain size 3.6μ) as matting agent and sodium tert-octylphenoxyethoxyethane sulfonate as a coating promotor were added to lime treated, bovine gelatin, and Compound 1 of this invention, Comparative Compound (I) shown above or Comparative Compound (II) were individually added respectively as hardening agents in the proportions shown in Table 2 to the aqueous gelatin solution. The amounts of gelatin, matting agent and coating promotor coated on one surface were 1.5 g/m², 40 mg/m², and 50 mg/m² respectively.

Comparative Compound (II)

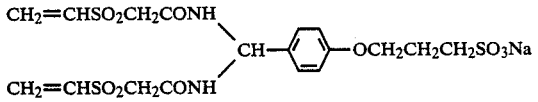

(iii) Measurement of the Extents of Swelling of the Coated Samples

The coated samples were left to stand in an environment of temperature 25° C., relative humidity 50%. Samples were taken out on the third and seventh days after coating and the thicknesses of the swelled films on immersion in water at 25° C. for a period of 3 minutes were measured. The film thickness was measured using a film thickness gauge made by the Amritsu Co.

TABLE 2

| Relationship with the Invention | Type of Hardening Agent | Amount Added (per 100 grams of Gelatin) | Swelling (μ) After 3 days | Swelling (μ) After 7 days |
|---|---|---|---|---|
| This Invention | Compound 1 of the Invention | 4 mmol | 14.8 | 14.8 |
| This Invention | Compound 1 of the Invention | 5 mmol | 12.7 | 12.5 |
| Comparison | Comparative Compound (I) | 4 mmol | 16.5 | 12.7 |
| Comparison | Comparative Compound (II) | 4 mmol | 16.5 | 13.2 |

It is clear from the results shown in Table 2 that the samples, in which Compound 1 of this invention had been used, hardened rapidly and that the hardening reaction had been completed in 3 days after coating. On the other hand, it is clear that the hardening reaction was still proceeding after 3 days in the case of the comparative samples. Also, the coated surface according to the present invention was found to have good conditions.

EXAMPLE 2

A sample consisting of a multi-layer color photosensitive material comprised of layers of which the compositions are indicated below on an undercoated cellulose triacetate film support was prepared. Composition of the photosensitive layers:

The coated weights of silver halide and colloidal silver are shown in units of grams of silver per square meter, the coated weights of couplers, additives and gelatin are shown in units of grams per square meter, and the amounts of the sensitizing dyes coated are shown as the number of mols per mol of silver halide in the same layer. The solvent is measured in g/m².

| First Layer (anti-halation layer) | |
|---|---|
| Black colloidal silver | 0.2 |
| Gelatin | 1.3 |
| EXM-8 | 0.06 |
| UV-1 | 0.1 |
| UV-2 | 0.2 |
| Solv-1 | 0.01 |
| Solv-2 | 0.01 |
| **Second Layer (Intermediate layer)** | |
| Fine grained silver halide (average grain size 0.07μ) | 0.10 |
| Gelatin | 1.5 |
| UV-1 | 0.06 |
| UV-2 | 0.03 |
| EXC-2 | 0.02 |
| EXF-1 | 0.004 |
| Solv-1 | 0.1 |
| Solv-2 | 0.09 |
| **Third Layer (First Red Sensitive Emulsion Layer)** | |
| Silver iodobromide emulsion (2 mol % AgI, high internal AgI type, corresponding sphere diameter 0.3μ, coefficient of variation of the corresponding sphere diameter 29%, regular crystals, twinned crystal mixed grains, diameter/thickness ratio 2.5) | 0.4 (as silver) |
| Gelatin | 0.6 |
| EXS-1 | $1.0 \times 10^{-4}$ |
| EXS-2 | $3.0 \times 10^{-4}$ |
| EXS-3 | $1 \times 10^{-5}$ |
| EXC-3 | 0.06 |
| EXC-4 | 0.06 |
| EXC-7 | 0.04 |
| EXC-2 | 0.03 |
| Solv-1 | 0.03 |
| Solv-3 | 0.012 |
| **Fourth Layer (Second Red Sensitive Emulsion Layer)** | |
| Silver iodobromide emulsion (5 mol % AgI, high internal AgI type, corresponding sphere diameter 0.7 μ, coefficient of variation of the corresponding sphere diameter 25%, regular crystals, twinned crystal mixed grains, diameter/thickness ratio 4) | 0.7 (as silver) |
| EXS-1 | $1.0 \times 10^{-4}$ |
| EXS-2 | $3.0 \times 10^{-4}$ |
| EXS-3 | $1 \times 10^{-5}$ |
| EXC-3 | 0.24 |
| EXC-4 | 0.24 |
| EXC-7 | 0.04 |
| EXC-2 | 0.04 |
| Solv-1 | 0.15 |
| Solv-3 | 0.02 |
| **Fifth Layer (Third Red Sensitive Emulsion Layer)** | |
| Silver iodobromide emulsion (10 mol % AgI, high internal AgI type, corresponding sphere diameter 0.8 μ, coefficient of | 1.0 (as silver) |

-continued

| | |
|---|---|
| variation of the corresponding sphere diameter 16%, regular crystals, twinned crystal mixed grains, diameter/thickness ratio 1.3) | |
| Gelatin | 1.0 |
| EXS-1 | $1 \times 10^{-4}$ |
| EXS-2 | $3 \times 10^{-4}$ |
| EXS-3 | $1 \times 10^{-5}$ |
| EXC-5 | 0.05 |
| EXC-6 | 0.1 |
| Solv-1 | 0.01 |
| Solv-2 | 0.05 |
| **Sixth Layer (Intermediate Layer)** | |
| Gelatin | 1.0 |
| Cpd-1 | 0.03 |
| Solv-1 | 0.05 |
| **Seventh Layer (First Green Sensitive Emulsion Layer)** | |
| Silver iodobromide emulsion (2 mol % AgI, high internal AgI type, corresponding sphere diameter 0.3 μ, coefficient of variation of the corresponding sphere diameter 28%, regular crystals, twinned crystal mixed grains, diameter/thickness ratio 2.5) | 0.30 (as silver) |
| EXS-4 | $5 \times 10^{-4}$ |
| EXS-6 | $0.3 \times 10^{-4}$ |
| EXS-5 | $2 \times 10^{-4}$ |
| Gelatin | 1.0 |
| EXM-9 | 0.2 |
| EXY-14 | 0.03 |
| EXM-8 | 0.03 |
| Solv-1 | 0.5 |
| **Eighth Layer (Second Green Sensitive Emulsion Layer)** | |
| Silver iodobromide emulsion (4 mol % AgI, high internal AgI type, corresponding sphere diameter 0.6 μ, coefficient of variation of the corresponding sphere diameter 38%, regular crystals, twinned crystal mixed grains, diameter/thickness ratio 4) | 0.4 (as silver) |
| EXS-4 | $5 \times 10^{-4}$ |
| EXS-5 | $2 \times 10^{-4}$ |
| EXS-6 | $0.3 \times 10^{-4}$ |
| EXM-9 | 0.25 |
| EXY-8 | 0.03 |
| EXM-10 | 0.015 |
| EXM-14 | 0.01 |
| Solv-1 | 0.2 |
| **Ninth Layer (Third Green Sensitive Emulsion Layer)** | |
| Silver iodobromide emulsion (6 mol % AgI, high internal AgI type, corresponding sphere diameter 1.0 μ, coefficient of variation of the corresponding sphere diameter 80%, regular crystals, twinned crystal mixed grains, diameter/thickness ratio 1.2) | 0.85 (as silver) |
| Gelatin | 1.0 |
| EXS-7 | $3.5 \times 10^{-4}$ |

-continued

| | |
|---|---|
| EXS-8 | $1.4 \times 10^{-4}$ |
| EXM-11 | 0.01 |
| EXM-12 | 0.03 |
| EXY-13 | 0.20 |
| EXM-8 | 0.02 |
| EXY-15 | 0.02 |
| Solv-1 | 0.20 |
| Solv-2 | 0.05 |
| **Tenth Layer (Yellow Filter Layer)** | |
| Gelatin | 1.2 |
| Yellow colloidal silver | 0.08 |
| Cpd-2 | 0.1 |
| Solv-1 | 0.3 |
| **Eleventh Layer (First Blue Sensitive Emulsion Layer)** | |
| Silver iodobromide emulsion (4 mol % AgI, high AgI type, corresponding sphere diameter 0.5 μ, coefficient of variation of the corresponding sphere diameter 15%, octahedral grains) | 0.4 (as silver) |
| Gelatin | 1.0 |
| EXS-9 | $2 \times 10^{-4}$ |
| EXY-16 | 0.9 |
| EXY-14 | 0.07 |
| Solv-1 | 0.2 |
| **Twelfth Layer (Second Blue Sensitive Emulsion Layer)** | |
| Silver iodobromide emulsion (10 mol % AgI, high internal AgI type, corresponding sphere diameter 1.3 μ, coefficient of variation of the corresponding sphere diameter 25%, regular crystals, twinned crystal mixed grains, diameter/thickness ratio 4.5) | 0.5 (as silver) |
| Gelatin | 0.6 |
| EXS-9 | $1 \times 10^{-4}$ |
| EXY-16 | 0.25 |
| Solv-1 | 0.07 |
| **Thirteenth Layer (First Protective Layer)** | |
| Gelatin | 0.8 |
| UV-1 | 0.1 |
| UV-2 | 0.2 |
| Solv-1 | 0.01 |
| Solv-2 | 0.01 |
| **Fourteenth Layer (Second Protective Layer)** | |
| Fine grain silver bromide (average grain size 0.07 μ) | 0.5 |
| Gelatin | 0.45 |
| Poly(methyl methacrylate) grains (diameter 1.5 μ) | 0.2 |
| Compound 1 of the invention | 0.6 |
| Cpd-3 | 0.5 |
| Cpd-4 | 0.5 |

Surfactant was added as a coating promotor to each layer as well as the components indicated above.

The chemical structural formula or name of each compound used in the invention is indicated below.

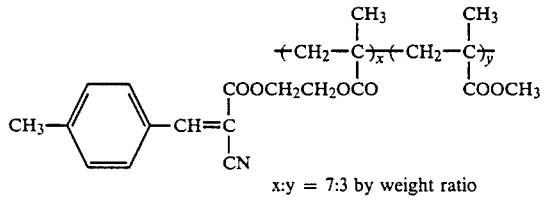

UV-1 x:y = 7:3 by weight ratio

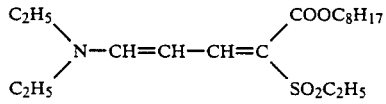

UV-2

Tricresyl phosphate — Solv-1

Dibutyl phthalate — Solv-2

-continued
Bis(2-ethylhexyl) phthalate — Solv-3
EXF-1
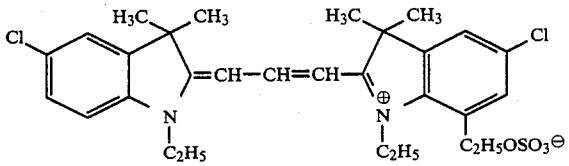
EXC-2
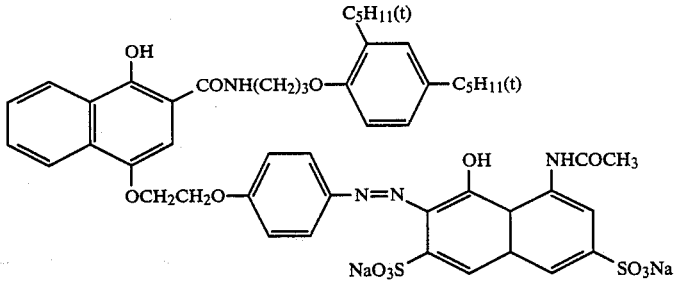
EXC-3
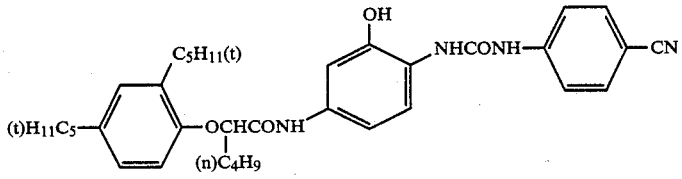
EXC-4
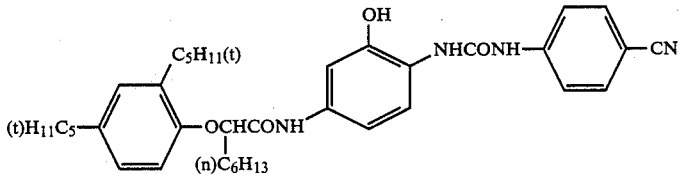
EXC-5
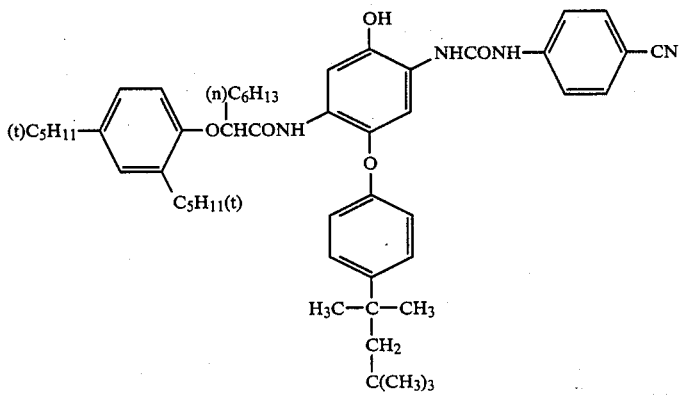
EXC-6
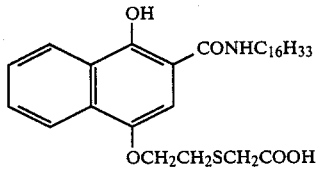

-continued
EXC-7
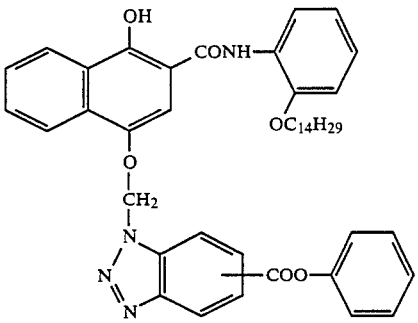
EXS-1
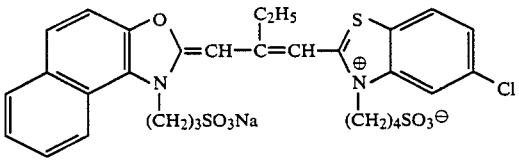
EXS-2
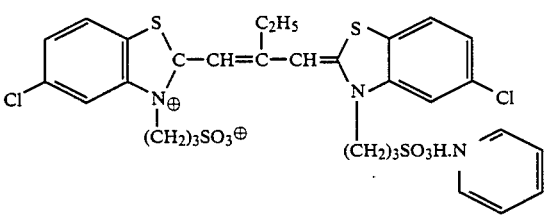
EXS-3
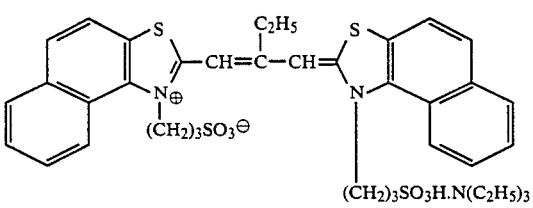
EXS-4
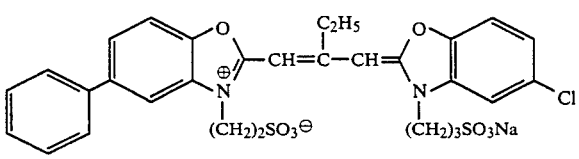
EXS-5
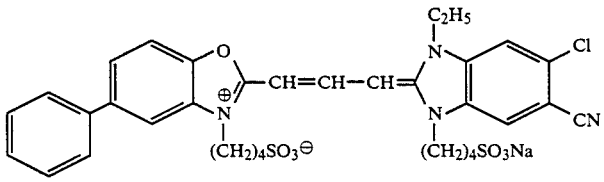
EXS-6
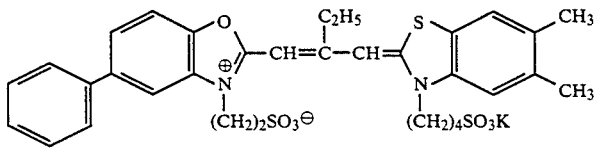
EXS-7
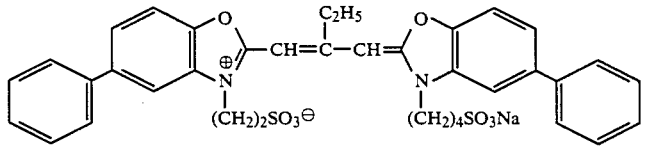

-continued
EXS-8
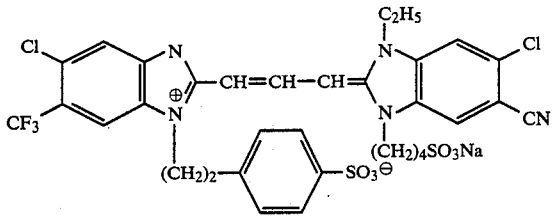
EXS-9
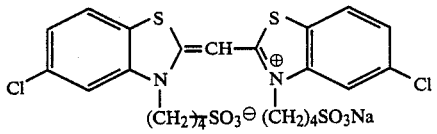
Cpd-1
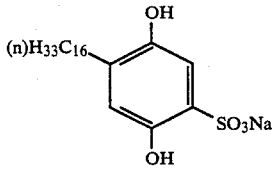
Cpd-2
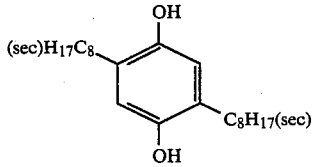
Cpd-3
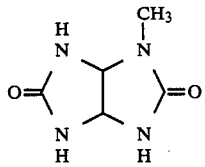
Cpd-4
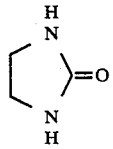
EXY-14
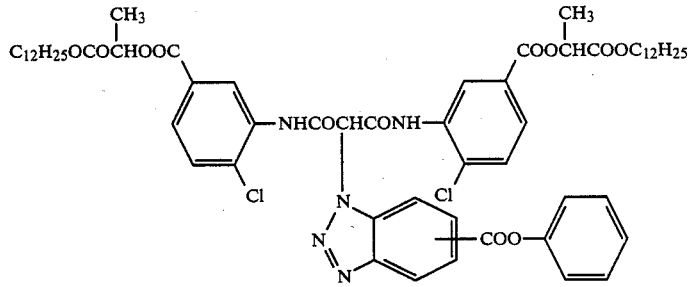

-continued
EXY-15
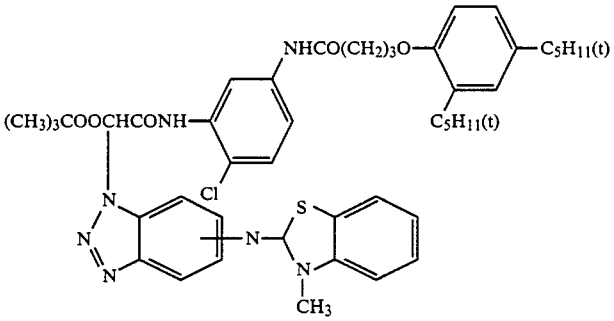
EXY-16
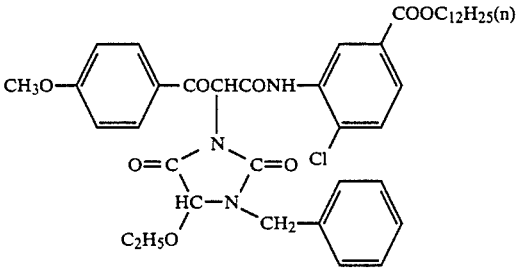
EXM-8
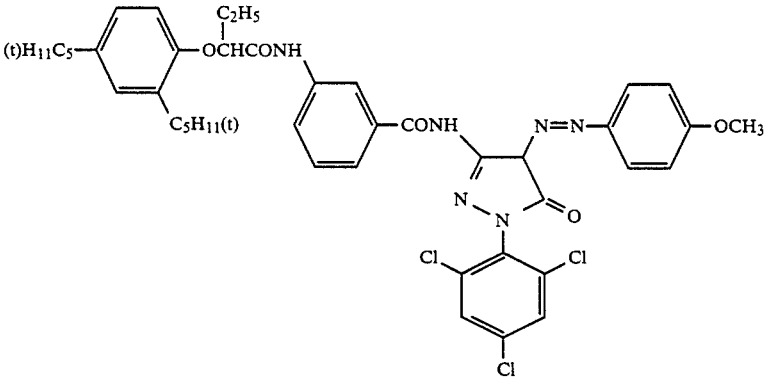
EXM-9
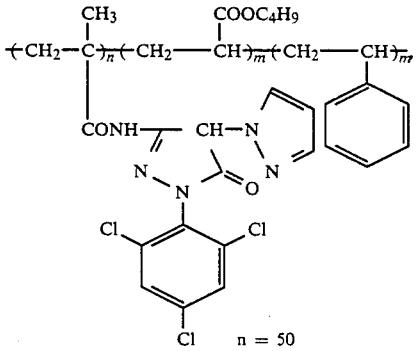
n = 50
m = 25
m' = 25
Molecular Weight = about 20,000

-continued

EXM-10

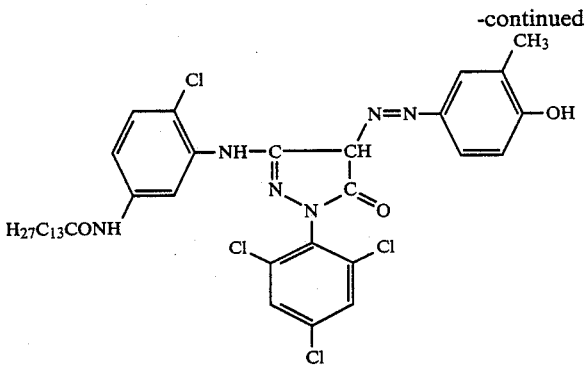

EXM-11

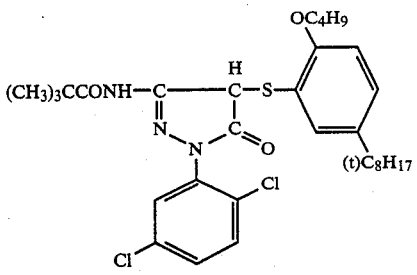

EXM-12

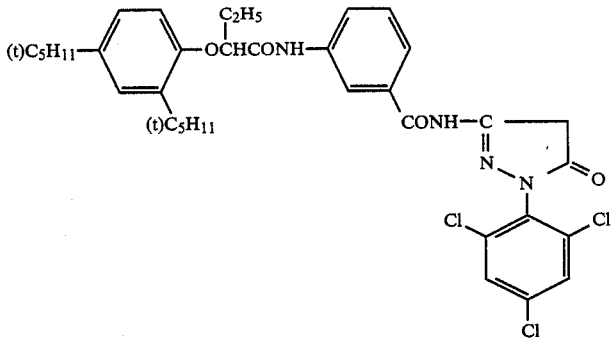

EXM-13

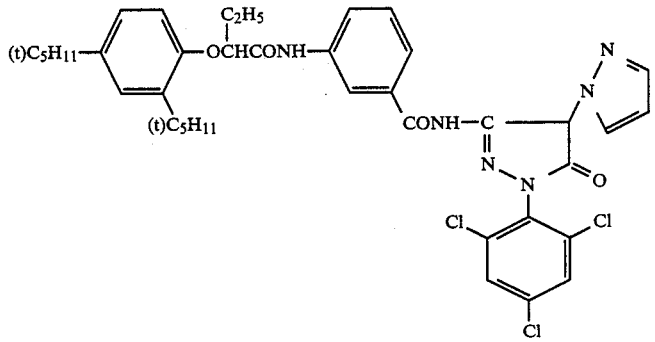

The samples obtained were stored for 3 or 7 days at room temperature and then exposed to white light of 4800° K. through a wedge and developed using CN-16 processing baths (made by Fuji Photo Film Co., Ltd.). The samples were examined sensitometrically using a densitometer fitted with status M filters, and the results obtained showed that the samples according to the present invention which had been stored for 3 days had a good photographic performance, and that the performances of the samples stored for 3 days and 7 days were the same. Moreover when Comparative Compound (II) used in Example 1 was coated at the rate of 0.7 grams per square meter in place of Compound 1 of this invention and samples were tested in the same way as described above, a good photographic performance was only observed with the sample which had been stored for 7 days, an increase in minimum density and a hardening of contrast in the photographic tonality being observed with the sample which had been stored for 3 days.

EXAMPLE 3

The layers 1 (bottom layer) to 7 (top layer) indicated in Table 3 were coated onto a paper support which had been laminated on both sides with polyethylene to prepare a multi-layer color photographic material. Illustrative Compound 1 of this invention was used at the rate of 2.5 wt % with respect to the gelatin as a hardening agent in each layer.

The samples obtained were subjected to an image exposure after being stored for 3 or 7 days at room temperature and then color developed under the conditions indicated below.

| Processing Operation | Temperature | Time |
|---|---|---|
| Color development | 33° C. | 3 min. 30 sec. |
| Bleach-Fix | 33° C. | 1 min. 30 sec. |
| Water Wash | 24–34° C. | 3 min. |
| Drying | 80° C. | 1 min. |

The compositions of the processing baths were as follows:

| Color Development Bath | |
|---|---|
| Water | 800 ml |
| Diethylenetriamine penta-acetic acid | 3.0 grams |
| Benzyl alcohol | 15 ml |
| Diethylene glycol | 10 ml |
| Sodium sulfite | 2.0 grams |
| Potassium bromide | 0.5 grams |
| Potassium carbonate | 30.0 grams |
| N—Ethyl-N—(β-methanesulfonamidoethyl)-3-methyl-4-aminoaniline sulfate | 5.0 grams |
| Hydroxylamine sulfate | 4.0 grams |
| Fluorescent whitener (4,4'-distilbene based) | 1.0 gram |
| Water | to make up to 1000 ml |
| (pH(25° C.): 10.10) | |

| Bleach-Fix Bath | |
|---|---|
| Water | 400 ml |
| Ammonium thiosulfate (70% solution) | 150 ml |
| Sodium sulfite | 18 grams |
| Ethylenediamine tetra-acdetic acid iron(III) ammonium salt | 55 grams |
| Ethylenediamine tetra-acdetic acid disodium salt | 5 grams |

TABLE 3

| Layer | Principal Composition | Use Rate* ($g/m^2$) |
|---|---|---|
| Seventh Layer (Protective Layer) | Gelatin | 1.33 |
| | Acrylic modified polymer of polyvinyl alcohol (17% modification) | 0.17 |
| Sixth Layer (Ultraviolet Absorbing Layer) | Gelatin | 0.54 |
| | Ultraviolet Absorber (h) | $5.1 \times 10^{-4}$ $mol/m^2$ |
| | Solvent (j) | 0.08 |
| Fifth Layer (Red Sensitive Layer) | Silver chlorobromide emulsion, (1 mol % AgBr, Average grain size 0.5 μm) | 0.22 as Ag |
| | Silver bromide emulsion (Average grain size 0.1 μm) | 0.005 as Ag |
| | Gelatin | 0.90 |
| | Cyan coupler (k) | $7.05 \times 10^{-4}$ $mol/m^2$ |
| | Colored image stabilizer (l) | $5.20 \times 10^{-4}$ $mol/m^2$ |
| | Solvent (m) | 0.22 |
| Fourth Layer (Ultraviolet Absorbing Layer) | Gelatin | 1.60 |
| | Ultraviolet absorber (h) | $1.70 \times 10^{-4}$ $mol/m^2$ |
| | Anti-color mixing agent (i) | $1.60 \times 10^{-4}$ $mol/m^2$ |
| | Solvent (j) | 0.27 |
| Third Layer (Green Sensitive Layer) | Silver chlorobromide emulsion, (1 mol % AgBr, Average grain size 0.5 μm) | 0.15 as Ag |
| | Silver bromide emulsion (Average grain size 0.1 μm) | 0.007 as Ag |
| | Gelatin | 1.56 |
| | Magenta coupler (e) | $3.38 \times 10^{-4}$ $mol/m^2$ |
| | Colored image stabilizer (f) | $1.69 \times 10^{-4}$ $mol/m^2$ |
| | Solvent (g) | 0.57 |
| Second Layer (Anti-Color Mixing Layer) | Gelatin | 0.70 |
| | Anti-color mixing agent (d) | $2.33 \times 10^{-4}$ $mol/m^2$ |
| First Layer (Blue Sensitive Layer) | Silver chlorobromide emulsion, (2 mol % AgBr, Average grain size 0.8 μm) | 0.35 as Ag |
| | Gelatin | 1.35 |
| | Yellow Coupler (a) | $6.91 \times 10^{-4}$ $mol/m^2$ |
| | Colored image stabilizer (b) | 1.13 |
| | Solvent (c) | 0.02 |
| Support | Polyethylene laminated paper (With white pigment ($TiO_2$) and blue dye (ultramarine dye etc.) in the polyethylene on the first layer side) | |

*Unless other units are given

The following spectral sensitizing agents were used for each emulsion:

Blue Sensitive Emulsion Layer:

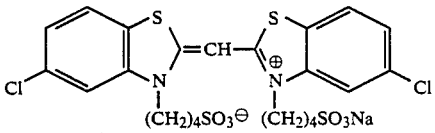

($4.0 \times 10^{-4}$ mol added per mol of silver halide)

Green Sensitive Emulsion Layer

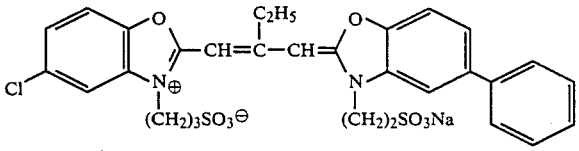

($3.0 \times 10^{-4}$ mol added per mol of silver halide)

Red Sensitive Emulsion Layer

-continued
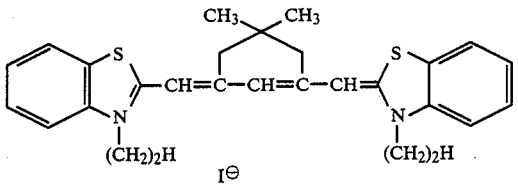
(1.0 × $10^{-4}$ mol added per mol of silver halide)
The following dyes were used as anti-irradiation dyes in each emulsion layer. Green Sensitive Emulsion Layer
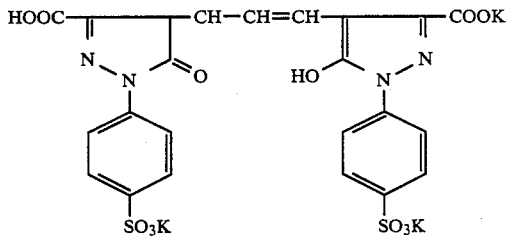
The structural formulae of the compounds used as couplers etc. in this example were as follows:
(a)
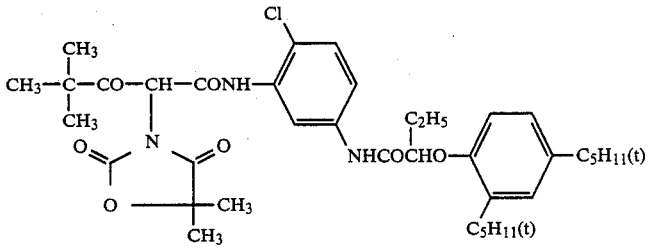
(b)
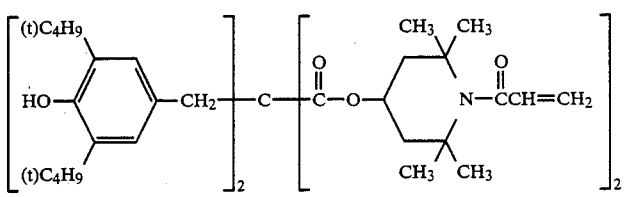
(c)
$(isoC_9H_{19}O)_3P{=}O$
(d)
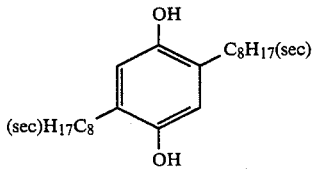
(e)
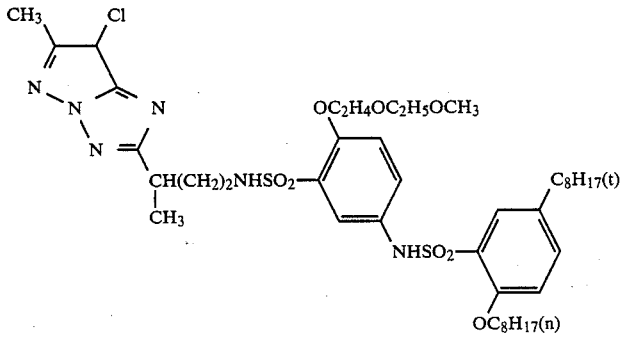

-continued
(f)
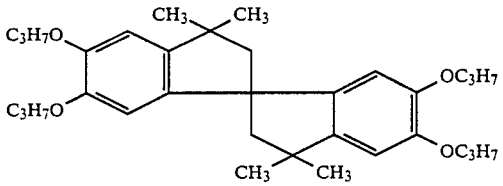
(g)
A 2:1 (by weight) mixture of: $(C_8H_{17}O)_3P{=}O$ and
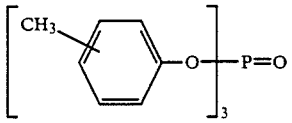
(h)
A 1:5:3 (mol ratio) mixture of
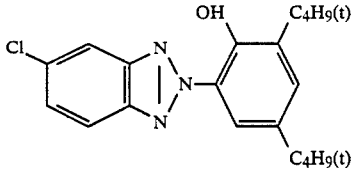
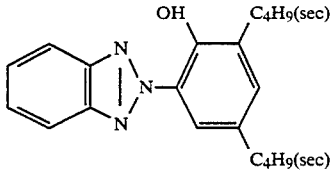
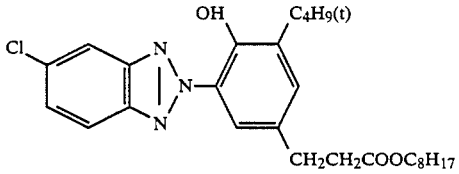
(i)
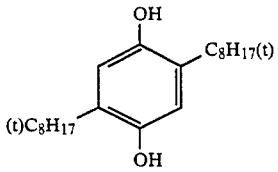
(j)
$(isoC_9H_{19}O)_3P{=}O$
(k)
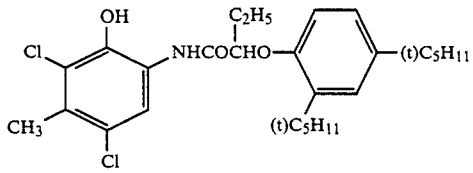
(l)
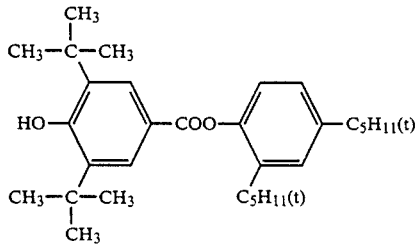

-continued (m)

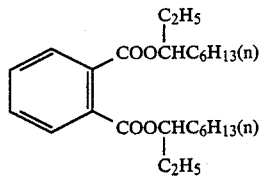

On assessing the photographic performance of the two samples which had been processed in this way it was found that both were very good. Moreover, similar results were obtained even when a development bath obtained by omitting the benzyl alcohol from the color development bath described above was used. Furthermore, when similar tests were carried out using Comparative Compound (II) used in Example 1 in place of Compound 1 of this invention, the sample which had been stored for 7 days had a good photographic performance while the sample which had been stored for 3 days did not.

EXAMPLE 4

A silver nitrate solution and a halide solution consisting of sodium chloride and potassium bromide were added using the double jet method to an aqueous gelatin solution which was being maintained at 45° C., and a monodisperse, cubic silver chlorobromide emulsion (70 mol % Cl) of which the average grain size was 0.20μ was obtained. At this time $7\times10^{-8}$ mol per mol of silver of triammonium hexachlororhodium and $3\times10^{-7}$ mol per mol of silver of tripotassium hexachloroiridium were added. The emulsion was washed with water and de-salted in the usual manner and then chemically sensitized by the addition of sodium thiosulfate and chloroauric acid and an emulsion was obtained. An emulsion layer coating solution was then prepared by adding (D-1) as a sensitizing dye, 4-hydroxy-6-methyl-1,3,3a,7-tetrazaindene and 1-phenyl-5-mercaptotetrazole as stabilizers and a poly(ethylacrylate) dispersion, 100 mg per mol of silver of Compound (4), Compound (1), and moreover 3 wt % with respect to the gelatin of Compound 4 of this invention as a film hardening agent to this emulsion.

A protective layer coating solution was obtained by adding poly(methyl methacrylate) as a matting agent and Compounds (2) and (3) as coating promotors to a gelatin solution.

(D-1)

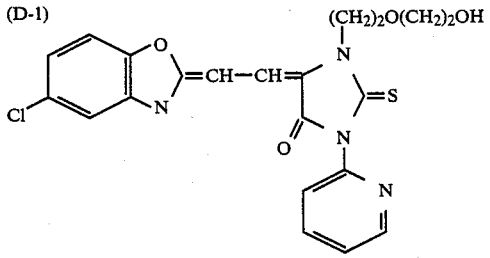

Compound (1) $C_{17}H_{35}CON(CH_3)CH_2CH_2SO_3Na$

Compound (2)

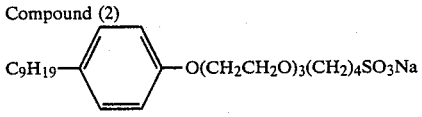

-continued

Compound (3)

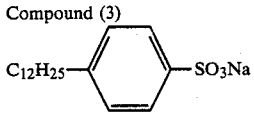

Compound (4)

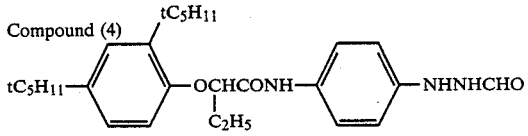

An emulsion layer and a protective layer were coated in the above order from the support on a polyethyleneterephthalate support.

| | |
|---|---|
| Amount of Gelatin Coated: | Emulsion Layer 1.9 grams per square meter<br>Protective Layer 1.2 grams per square meter |
| Amount of Silver Coated: | 3.5 grams per square meter |
| Amount of Hardening Agent Coated: | 0.15 grams per square meter |

Image Evaluation:

An original with white and black lines of width 40 μm was prepared using manual photosetting paper PL-100WP (made by Fuji Photo Film Co., Ltd.). The white lines were provided on a solid back background and the black lines were provided on a white background. The widths of the black and white lines was confirmed at 40 μm with and optical density of 0.6 by scanning the original in the direction of the line width using a reflection densitometer. The original manual photosetting paper with black and white lines obtained in this way was photographed on the samples disclosed in this example (which had been stored for 3 and 7 days at room temperature after coating) using a DSC-315 reflection type plate making camera (made by the Dainippon Screen Co.) and the samples were developed. The development bath indicated below was used for a 30 second development at 34° C. and this was followed by the usual fixing, washing and drying operations.

| Development Bath Formula | |
|---|---|
| Hydroquinone | 45.0 grams |
| N—Methyl-p-aminophenol hemi-sulfate | 0.8 grams |
| Sodium hydroxide | 18.0 grams |
| Potassium hydroxide | 55.0 grams |
| 5-sulfosalicylic acid | 45.0 grams |
| Boric acid | 25.0 grams |
| Sodium sulfite | 110.0 grams |
| Ethylenediamine tetra-acetic acid di-sodium salt | 1.0 gram |
| Potassium bromide | 6.0 grams |
| 5-Methylbenzotriazole | 0.6 grams |
| n-Butyl-diethanolamine | 15.0 grams |
| Water | to make up to 1 liter |

-continued

| Development Bath Formula |
|---|
| (pH = 11.6) |

The processed samples both displayed good images.

On the other hand, when the same test was carried out using Comparative Compound (II) used in Example 1 in place of Compound 1 of this invention, only the sample which had been stored for 7 days had a good photographic performance.

EXAMPLE 5

Six parts of acid treated gelatin which had an isoelectric point of 7.8 and 6 parts of gum arabic were dissolved in 30 parts of water at 40° C. and 0.5 parts of Turkey red oil was added as an emulsifying agent. Next 30 parts of diisopropylbiphenyl in which 2% of crystal violet lactone (CVL) had been dissolved was added to the colloidal solution and stirred vigorously to form an oil in water emulsion, and the stirring was stopped when the size of the oil droplets was 6 to 10μ. Next 250 parts of warm water at 45° C. was added to the emulsion. The pH was then adjusted to 4.5 by titration with 50% acetic acid while stirring the mixture. After stirring at this temperature for 15 minutes, the container was cooled from the outside, and the colloid walls which had accumulated were gelled and solidified. The stirring was continued and, when the liquid temperature reached 15° C., 100 parts of a 10% aqueous solution of Compound 9 of this invention was added as a hardening agent. When the liquid temperature reached 10° C. the dropwise addition of a 10% aqueous solution of caustic soda was started and the pH was finally raised to 10. After standing for 30 minutes, the temperature of the liquid was raised to 50° C. over a period of 20 minutes and capsules which contained CVL dissolved in diisopropylbiphenyl which had no coloration and which were resistant to heat were obtained.

To parts of a 15% aqueous solution of poly(vinyl alcohol) and 0.5 parts of starch were added to 10 parts of the capsule liquid obtained in this way to form a coating liquid, and this was coated with a coating rod onto a top paper in such a way as to provide a solid fraction coated weight of 20 grams per square meter.

On the other hand, 100 parts of sulfuric acid treated acidic kaolin was dispersed in 300 parts of water which contained 6 parts of a 40% aqueous caustic soda solution and, after dispersion in a homogenizer, 40 parts of styrene butadiene latex was added, and this was coated with a coating rod onto a 50 grams per square meter copy paper at a rate of 12 grams of solid fraction per square meter to provide a clay paper.

The coated side of the capsule coated paper and the coated side of the clay paper were brought together, and clear colored letters appeared when this was written upon. However, coagulum formed when a capsule liquid to which no hardener of this invention had been added was left to stand for comparison.

While the invention has been described in detail and with reference to specific embodiments thereof, it will be apparent to one skilled in the art that various changes and modifications can be made therein without departing from the spirit and scope thereof.

What is claimed is:

1. A method of hardening gelatin comprising adding to the gelatin to be hardened at least one compound represented by formula (I)

$$(CH_2{=}CH{-}SO_2)_2\underset{\underset{R}{|}}{C}{-}L{-}A{+}SO_3^{\ominus}M^{\oplus})_n \qquad (I)$$

wherein L represents a divalent organic group, R represents a hydrogen atom or a univalent organic group, A represents a substituted or unsubstituted benzene ring which may be condensed with another ring, $M^{\oplus}$ represents a hydrogen ion, an alkali metal ion or an ammonium ion, and n has a value of 1 or 2 or 3.

2. A method of hardening gelatin as in claim 1, wherein L in formula (I) is selected from the group consisting of an alkylene group which has from 1 to 10 carbon atoms, an alkenylene group which has from 2 to 10 carbon atoms, an arylene group which has from 6 to 10 carbon atoms, and a divalent group represented by —O—, $$-\underset{\underset{R^1}{|}}{CON}-,\ -COO-,\ -S-,\ -SO-,\ -SO_2-,\ \text{or}$$

$$-\underset{\underset{R^1}{|}}{SO_2N}-\ \text{individually or}$$

by a combination of these divalent groups, wherein $R^1$ is selected from the group consisting of a hydrogen atom, an alkyl group which has from 1 to 10 carbon atoms, an aryl group which has from 6 to 10 carbon atoms and an aralkyl group which has from 7 to 10 carbon atoms.

3. A method of hardening gelatin as in claim 1, wherein A represents a benzene ring which may be condensed with other rings and which may be substituted with substituent groups selected from the group consisting of halogen atoms, alkyl or alkoxy groups which have from 1 to 10 carbon atoms, aryl or aryloxy groups which have from 6 to 10 carbon atoms, aralkyl or aralkyloxy groups which have from 7 to 10 carbon atoms, acylamino groups which have from 1 to 10 carbon atoms and substituted or unsubstituted carbamoyl groups.

4. A method of hardening gelatin as in claim 1, wherein R is selected from the group consisting of a hydrogen atom, an alkyl group which has from 1 to 10 carbon atoms, an aryl group which has from 6 to 10 carbon atoms and an aralkyl group which has from 7 to 10 carbon atoms.

5. A method of hardening gelatin as in claim 1, i wherein $M^{\oplus}$ is selected from the group consisting of $Na^{\oplus}$, $K^{\oplus}$ or $NH_4^{\oplus}$.

6. A method of hardening gelatin as in claim 1, wherein the amount of hardening agent used is within the range of from 0.01 to 20 wt % with respect to dry gelatin.

7. A method of hardening gelatin as in claim 1, wherein the amount of hardening agent used is within the range of from 0.05 to 10 wt % with respect to the dry gelatin.

8. A method as in claim 1, wherein said gelatin is a component of a photographic material.

9. A method as in claim 1, wherein the gelatin to which the compound of formula (I) is added is mixed with up to 50% of colloidal albumin, casein, a cellulose derivative, agar, sodium alginate, a sugar derivative, a synthetic hydrophilic colloid or derivatives or partial hydrolyzates thereof or a gelatin derivative.

10. A method of forming hardened gelatin capsules, comprising the steps of emulsifying oil in water, effecting coacervation, cooling and gelling the coacervate, and hardening the capsules, wherein at least one compound represented by formula (I) is added to the capsules to be hardened $$(CH_2{=}CH{-}SO_2)_2\underset{\underset{R}{|}}{C}{-}L{-}A{\leftarrow}SO_3^{\ominus}M^{\oplus})_n \qquad (I)$$

wherein L represents a divalent organic group, R represents a hydrogen atom or a univalent organic group, A represents a substituted or unsubstituted benzene ring which may be condensed with another ring, $M^{\oplus}$ represents a hydrogen ion, an alkali metal ion or an ammonium ion, and n has a value of 1 or 2 or 3.

* * * * *